United States Patent [19]

Annand

[11] Patent Number: 5,007,120

[45] Date of Patent: Apr. 16, 1991

[54] SHOWER CURTAIN LINER CONTROL DEVICE

[76] Inventor: Charles A. Annand, 4 Ridgewood Drive, Truro, Nova Scotia, Canada, B2N 5C5

[21] Appl. No.: 344,994

[22] Filed: Apr. 23, 1989

[30] Foreign Application Priority Data

Jan. 20, 1989 [CA] Canada ..... 588731

[51] Int. Cl.[5] ..... A47K 3/00

[52] U.S. Cl. ..... 4/558; 4/609

[58] Field of Search ..... 4/558, 609, 610

[56] References Cited

U.S. PATENT DOCUMENTS

| | | | |
|---|---|---|---|
| 2,120,155 | 6/1937 | Shera . | |
| 2,173,993 | 9/1939 | Amdur . | |
| 2,219,075 | 9/1938 | Le Veau . | |
| 2,554,106 | 5/1951 | Heubeck | 160/349.2 |
| 2,573,985 | 3/1946 | Porter . | |
| 2,774,974 | 12/1956 | Zaloga . | |
| 2,776,439 | 1/1957 | Rondinelli . | |
| 2,778,030 | 1/1957 | Goche . | |
| 2,878,487 | 3/1959 | Foote . | |
| 3,382,507 | 5/1968 | Micheau . | |
| 3,418,665 | 12/1968 | Long . | |
| 3,872,520 | 3/1975 | Tyconik . | |
| 4,117,557 | 10/1978 | McPeak et al. . | |
| 4,229,842 | 10/1980 | Gilmore . | |
| 4,361,914 | 12/1982 | Oliver . | |
| 4,754,504 | 7/1988 | Cellini . | |

FOREIGN PATENT DOCUMENTS

| | | | |
|---|---|---|---|
| 2514632 | 10/1981 | France | 4/610 |

OTHER PUBLICATIONS

Slip-X Shower Splash Control, publication of Slip-X, division of Bissell, Inc., Grand Rapids, MI (date unknown).

*Primary Examiner*—Charles E. Phillips
*Attorney, Agent, or Firm*—Lalos & Keegan

[57] ABSTRACT

A device for use with and for controlling the position of a shower curtain of the type which may be mounted on a rod above the outside rim of a bathtub. Such shower curtains are usually suspended by curtain hooks slidable along the rod so that the curtain can be pulled between an open position adjacent one end of the bathtub to a closed position and thereby close off a shower area. The device of the present invention functions to hold the curtain away from the user of the shower and to further encourage the lower edge of the curtain to remain in engagement with the inside of the side wall of the tub below the outside rim thereof and thereby prevents cold air form entering the shower area. The device includes a downwardly extending section depending from a mounting section which is supported on the curtain rod, the downwardly extending section having a curtain engaging lower end. The lower end of the downwardly extending section is biased outwardly relative to the shower area by a portion attached to the mounting section and which causes the mounting section to pivot on the rod in a direction to swing the downwardly extending section in an outward direction. The portion attached to the mounting section can be in the form of an elongated section which extends inwardly from the mounting section and thus forms a weight causing the mounting section to pivot on the rod.

9 Claims, 7 Drawing Sheets

SHOWER CURTAIN LINER CONTROL DEVICE

BACKGROUND OF THE INVENTION

1. Field of the Invention

This invention relates to a shower curtain control device, and more particularly, to a device for mounting on a shower curtain rod and engaging the shower curtain in its closed condition in a manner to hold the shower curtain out of the shower area and encouraging the shower curtain to remain in a position in which a cold air draft does not enter the shower area over the rim of the bathtub.

2. Description of the Prior Art

When a shower is in use, there is a tendency for the shower curtain to blow in toward the user due to the turbulence caused in the air within the shower area and also due to the convection which is set up by the rapid heating effect of the fine streams of water. Cold air is sucked in under the lower edge of the shower curtain which causes discomfort due to the cold air draft and to the curtain engaging the user. One approach to solving this phenomenon has been the provision of small magnets attached to the lower edge of the shower curtain, or the curtain inner liner when the curtain is in the form of an outer decorative layer and an inner liner, both hanging from the same series of curtain rod hooks. The use of magnets has not fully solved the problem even when the bathtub is of the enameled metal type and it has no effect at all, of course, when used with the now available plastic or fiberglass type tubs.

SUMMARY OF THE INVENTION

According to the present invention, there is provided a control device for a shower curtain of the type suspended from a support rod extending beside a shower area. The device includes means for mounting the device on the rod, a curtain engaging portion depending from the mounting means, and means holding the depending portion away from the shower area.

More specifically, the device of the present invention is constructed for controlling the position of a shower curtain of the type suspended from a support rod of circular cross section positioned above an outside rim of a bathtub, the curtain being attached to curtain rod hooks slidable along the rod to enable the curtain to be extended from an open position to a closed position in which an inner surface of the curtain defines one side of a shower area. The device includes a mounting section having an opening for receiving the support rod and permitting both pivoting and sliding movement of the device on the rod, an elongated member connected to the mounting means and depending therefrom and having a lower end portion for engagement with the inner surface of the curtain at a location spaced between the support rod and rim of said bathtub, and biasing means causing pivoting of the mounting section in a direction to swing the lower end portion of the elongated member outward from the shower area, so that the curtain is held outward relative to the outer rim of the bathtub.

In the illustrated embodiment of the invention, the mounting section of the curtain control device includes an inverted U-shape defining the rod receiving opening between a pair of downwardly extending legs jointed by a curved mid-portion for riding on top of the rod. The elongated member may be continuous with and extends downwardly from the outside leg of the pair of legs, the lower end portion of the elongated member curving outwardly relative to the shower area and then inwardly. The biasing means may be in the form of an elongated portion joined at an inner end thereof to the inside leg of the pair and extending at an angle relative thereto and projecting over the shower area, and the elongated portion forming the biasing means which extends from a lower end of the inside leg in a direction inward and slightly upward relative to the shower area.

As will be more apparent from the following description, the present invention can be mounted on the curtain rod between the normal curtain rod hooks so as to slide on the rod as the curtain is closed, it being preferable to include several, such as three, of the devices between spaced pairs of the hooks in order that they are spread along the rod when the curtain is closed. Because the lower end of the elongated members of the devices swing to a position away from the shower area, they hold the curtain away from the user and cause the lower edge of the curtain, which becomes wetted, to adhere to the inside of the outer tub wall below the upper rim thereof.

BRIEF DESCRIPTION OF THE DRAWINGS

In the accompany drawings which illustrate one embodiment of the invention, as an example.

DESCRIPTION ON OF PREFERRED EMBODIMENT

Figure 2:
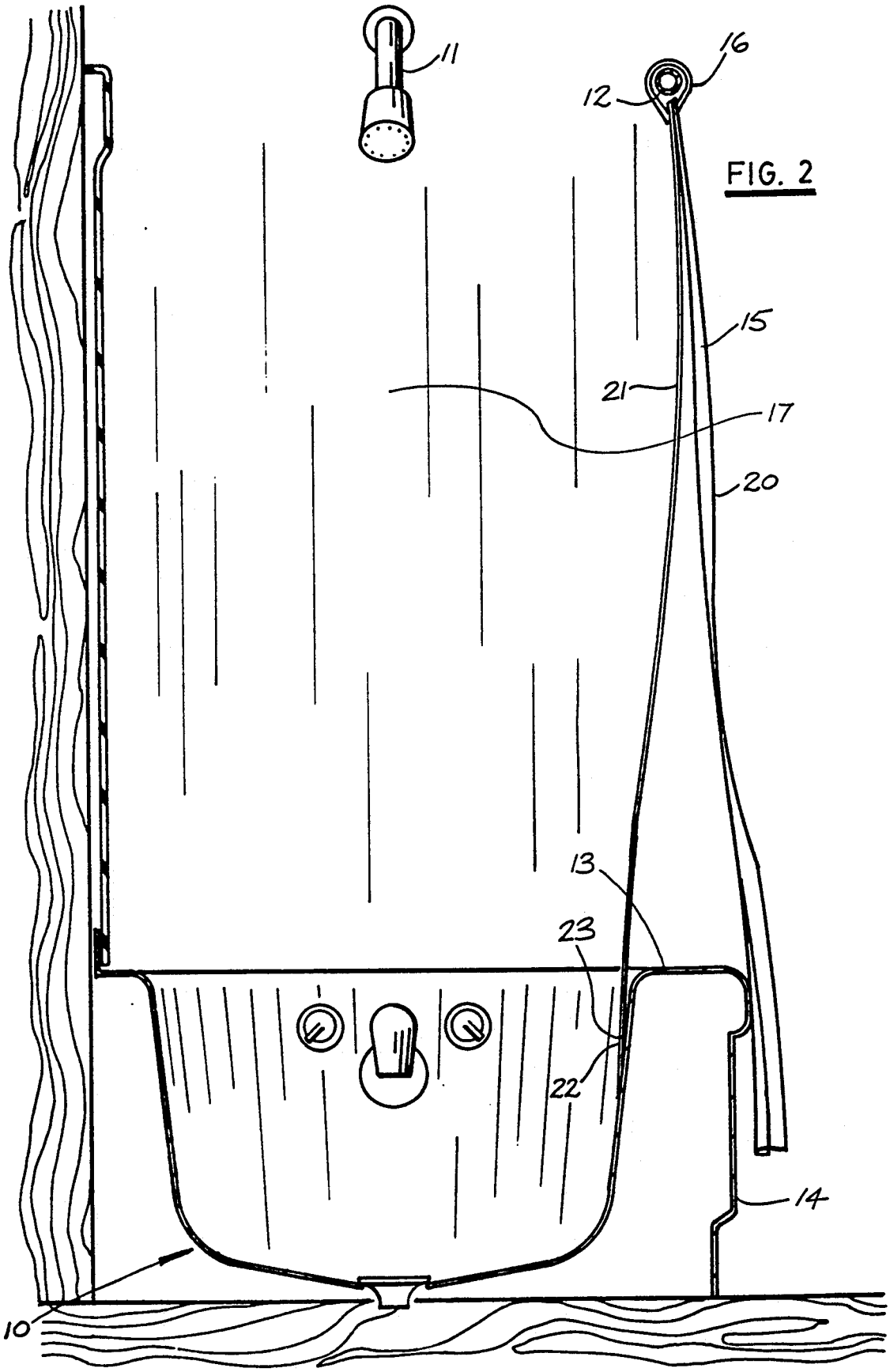
FIG. 2 is a cross sectional view, on a smaller scale, through a typical bathtub and showing the position of a shower curtain when the shower is not in use.

Turning first to FIG. 2 of the drawings, there is shown a bathtub 10 in conjunction with which there is provided a shower head 11 above one end of the tub. Normally, the tub is mounted in a cove defined by two end wall and one side wall, or alteratively, there are now available tubs with the two end walls, one solid sidewall, and one side wall formed with a large entrance opening wherein the walls are formed integrally therewith. In any event, it is common to provide a shower curtain rod 12 at the top of the open side, above and parallel to a rim 13 at the top of an outside wall 14 of the tub 10. The rod 12 is usually in the form of a chromed tubular member, or is at least of circular cross section. A shower curtain 15 is suspended from its upper edge by shower rod hooks 16 which are slidable along the rod 12 from an open condition (FIG. 6) to a closed condition (FIG. 5) so as to enclose a shower area 17 above the bathtub and in front of the shower head 11. The shower curtain 15 may be a single flexible sheet, or more usually, it consists of two sheets, an outer, possibly more decorative layer 20 and an inner, possibly more waterproof liner 21. As shown in FIG. 2 the height of the shower curtain is greater that the distance from the rim 13 to the rod 12 so that the lower edge of the curtain 15 hangs below the upper rim of the outer side wall 14, and it is usual for the outer layer to hang on the outer side of the wall 14 with the inner liner 21 having its lower portion 22 positioned against inside surface 23 of the wall 14.

Figure 3:
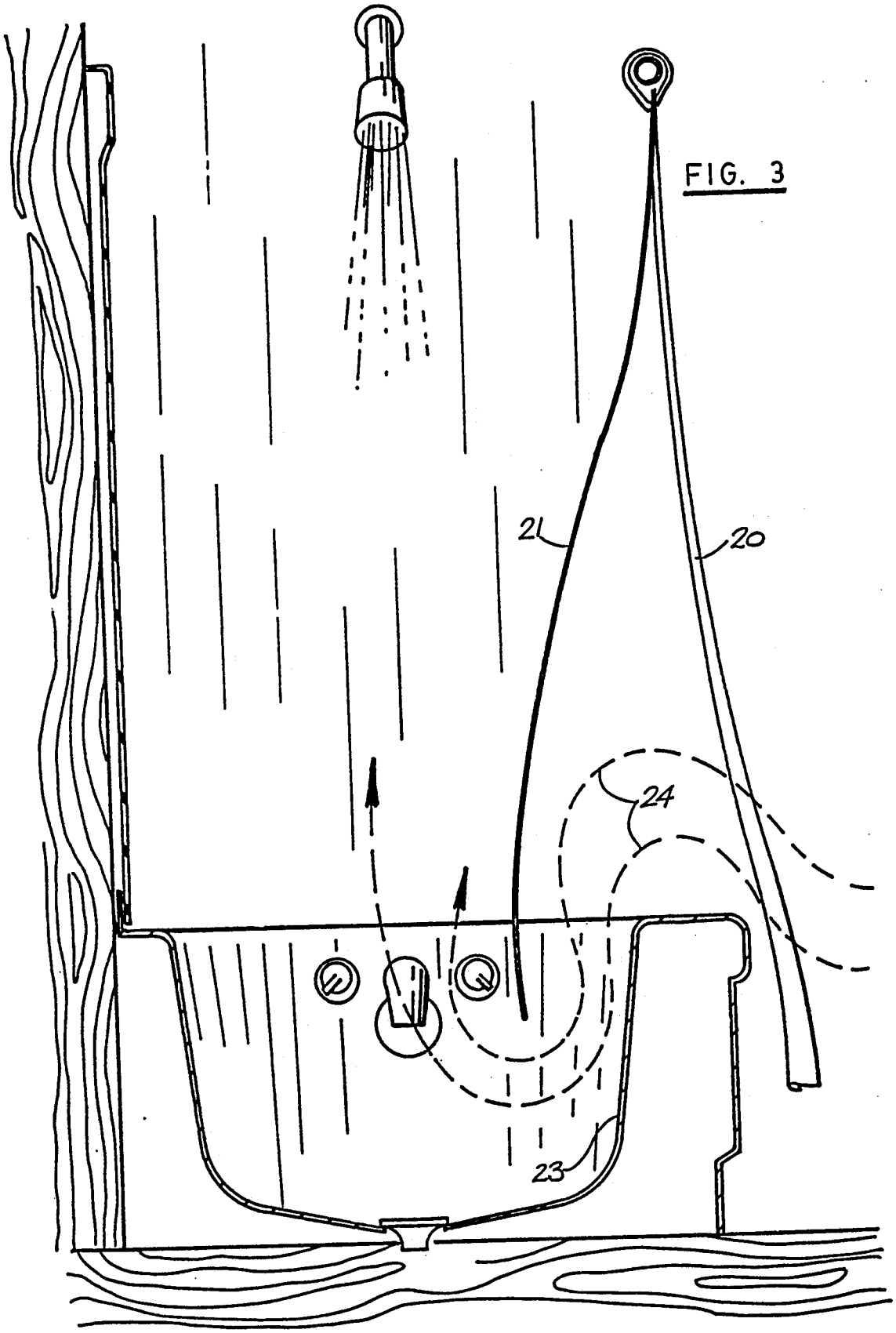
FIG. 3 is a view similar to FIG. 2, but showing the effect of the use of the shower without the presence of the device of the present invention.

When the shower is in use, as illustrated in FIG. 3, there is a tendency for cold air to rush into the lower part of the shower area 17 due to the turbulence and convection flow set up in the air mixed with the hot streams of water in the shower area. As indicated by arrows 24, the cold air flows over the rim 14 and down between the inner liner 21 and the inside surface 23 of the outside wall 14, causing the inner liner 21 to blow into the shower area 17, thus causing discomfort to the shower user. As previously indicated, attempts have been made to stop the flow of cold air into the tub by attaching a number of small magnets (not shown) to the lower portion of the liner so that it is attracted to the outside wall of the tub. This approach has not proven effective, and, of course, is not at all practical if the tub is not formed of ferrous material.

Figures 1, 9:
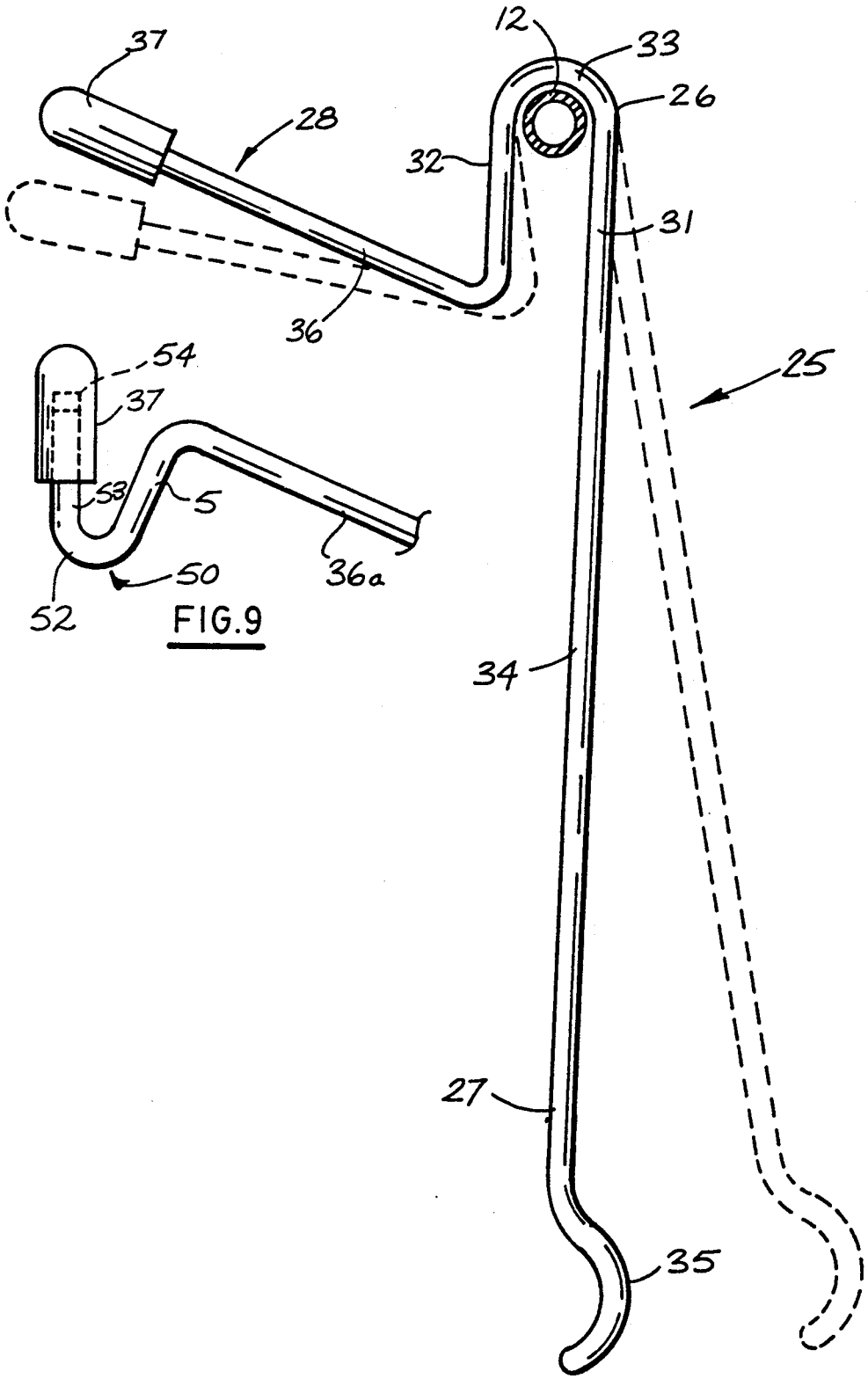
FIG. 1 is a side view of the device of the present invention mounted on a shower curtain rod and shown in solid lines in a position in which the shower curtain is hanging vertical, and shown in dashed lines in a position holding the curtain away from the shower area.
FIG. 9 is a side view of an alternative configuration of the portion of the device which provides the biasing effect.

In FIG. 1, the reference character 25 denotes the curtain control device of the present invention, and it includes a mounting means 26, a curtain engaging means 27 and a means 28 for biasing the curtain engaging means 27 to swing in a direction away from the shower area 17. In the illustrated embodiment, the mounting means 26, curtain engaging means 27 and biasing means 28 are formed as an integral unit, and may be molded from plastic, for example, in the form of a rod of 7/16" diameter or formed from a continuous steel rod of 3/16" diameter and plated with zinc. The mounting means 26 is provided with an opening to receive the rod 12 in a manner to be able to pivot on it and slide sideways therealong. The mounting means 26 is shown in the form of an inverted U-shape portion defined by a pair of spaced legs 31, 32 joined by a curved section 33. The spacing of the legs 31, 32 and the shape of the inside diameter of the curved section 33 is such that the device can be slid down over the rod 12 and the curved section 33 smoothly rides on the rod 12 as shown in FIG. 1.

The curtain engaging section 27 is shown in the form of a downwardly depending elongated section 34 coextensive with the outside leg 31 of the mounting means. The section 34 may, in the main, be straight but preferably terminates in a short curved section 35 which curves outwardly from the straight portion of section 34 and then slightly inward towards the shower area 17. The total length of the section 34 may be in the order of 30" so as to engage the curtain between the rod 12 and the upper rim of the bathtub.

The biasing means 28 is an elongated section 36 extending from the inside leg 32 of the mounting means inward toward the shower area. As is shown in FIG. 1 the section 36 is at an angle of less than 90° so that it is directly slightly upward when the section 34 is depending substantially vertical. While the inner end of the section 36 which is straight is connected to the leg 32 in a smooth curve, the outer end is provided with a weight 37. Thus, when the device 25 is hung on the rod 12, the biasing means 28 tends to cause the mounting means to pivot on the rod 12 in a direction to swing the curtain engaging means away from the shower area as indicated in the dashed lines of FIG. 1.

Figure 5:
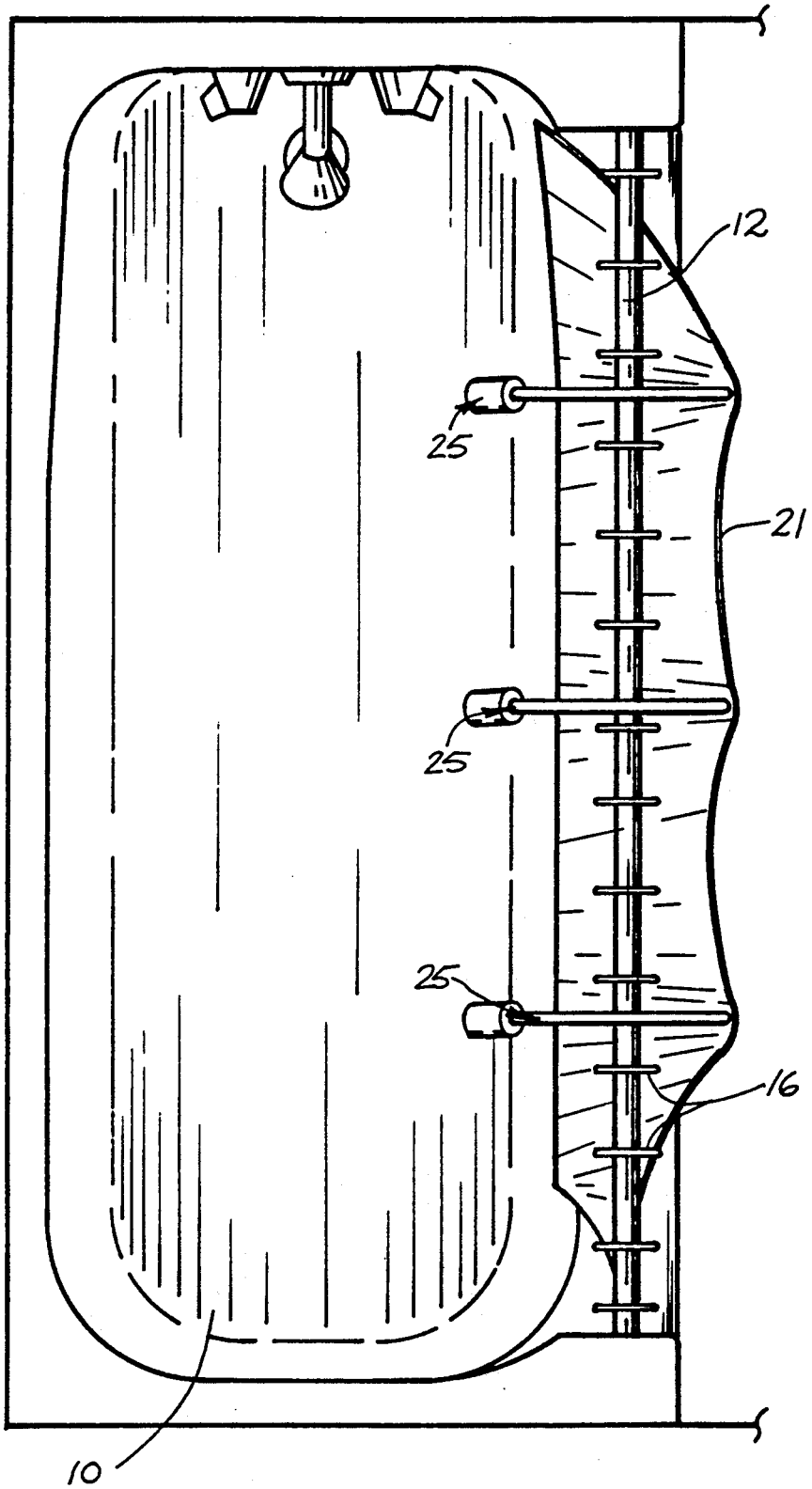
FIG. 5 is a top view of the tub and curtain arrangement of FIG. 4 and illustrating the typical positioning of three of the devices of the present invention.
Figure 6:
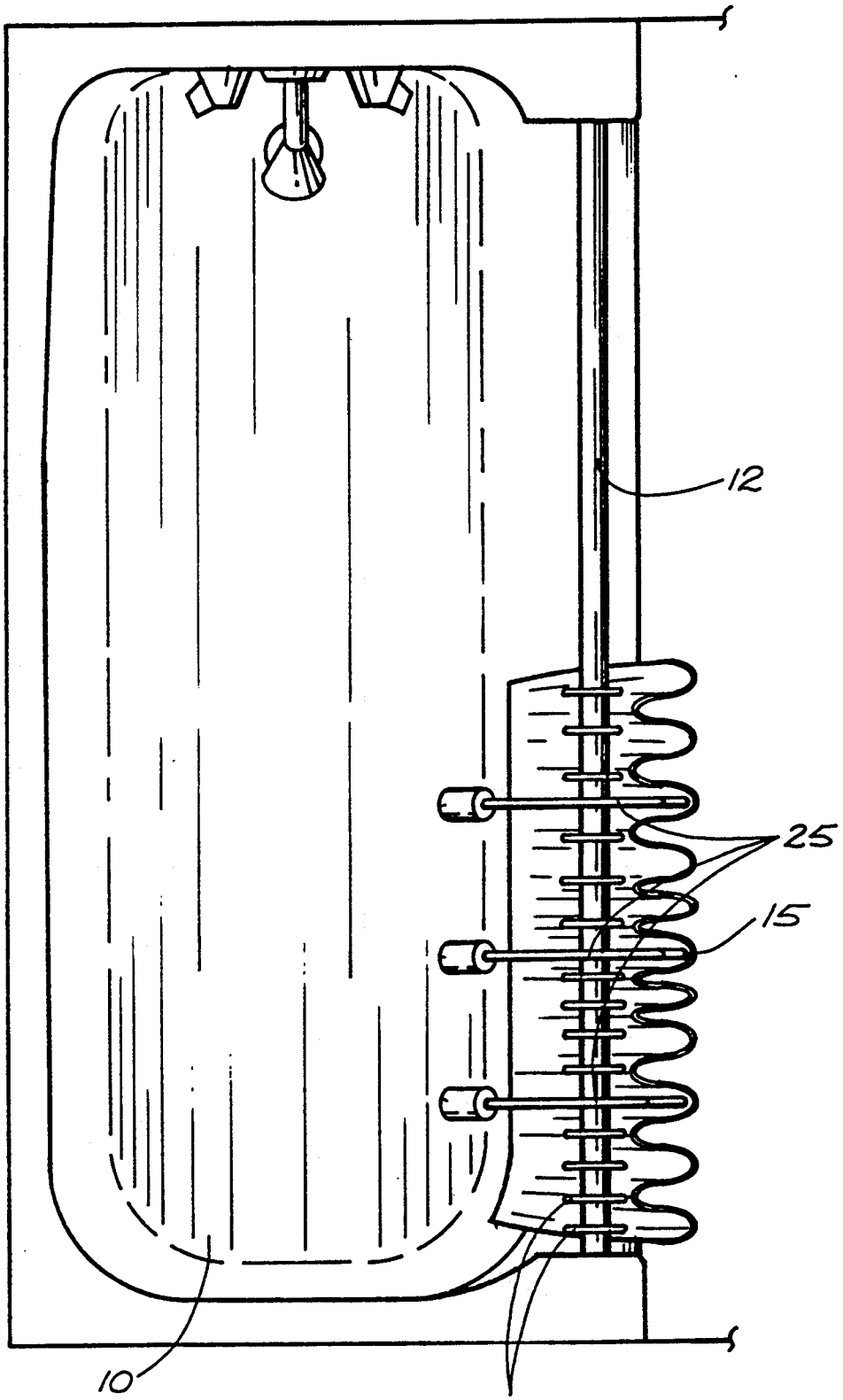
FIG. 6 is a view similar to FIG. 5, but showing the shower curtain in an open condition.

Preferably a plurality of the devices 25, such as three, are used as illustrated in FIG. 5, the devices being mounted between spaced pairs of shower rod hooks 16 so that the curtain is engaged by the device at a number of spaced points along its length. When the curtain is moved to its open position as shown in FIG. 6, the devices 25 slid with the hoods and remain interspaced with the hooks.

Figure 4:
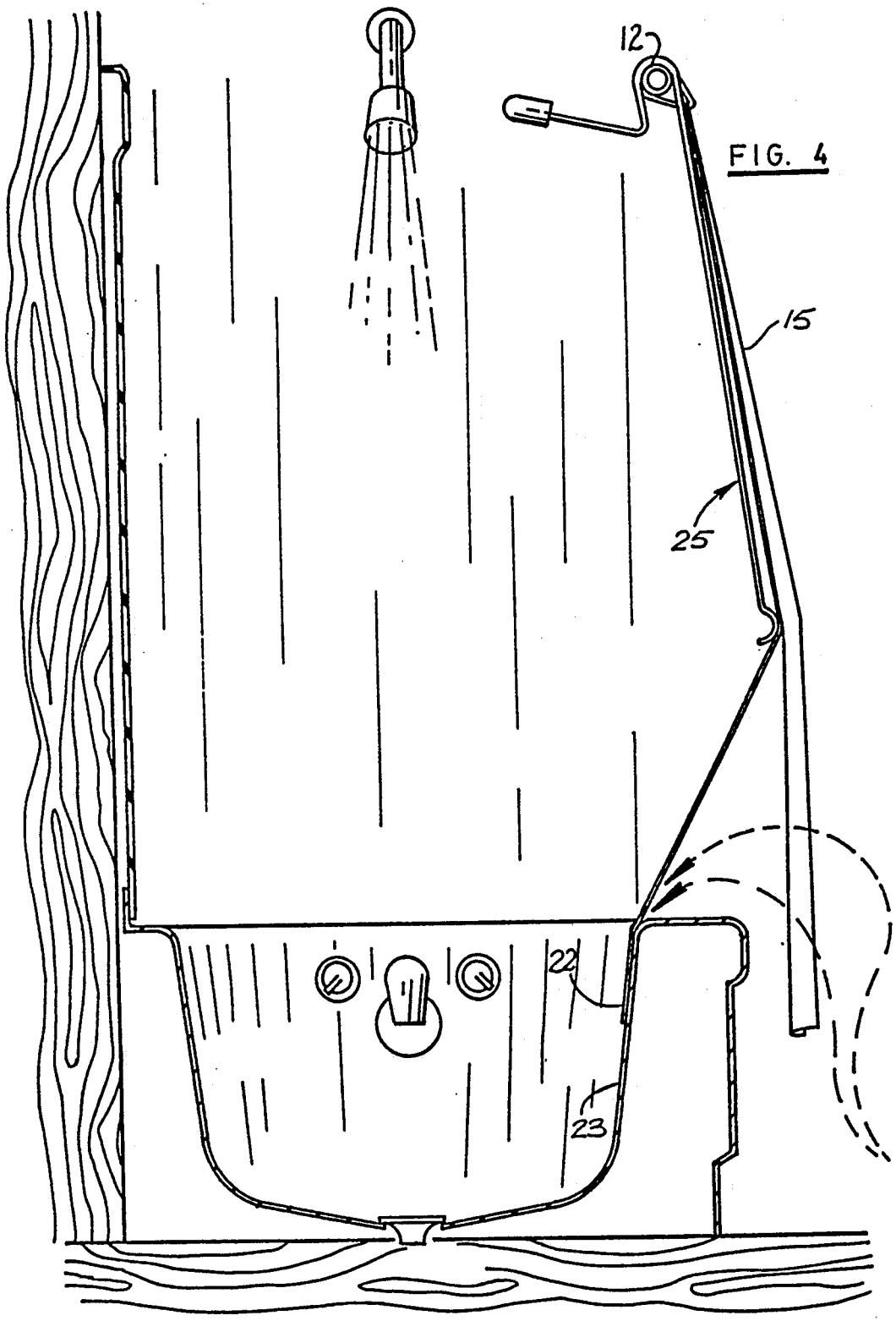
FIG. 4 is a view similar to FIG. 3 showing the operational effect of the present invention.

When the curtain is closed in preparation for a shower, the devices return to their spaced position, and due to the weight of the curtain, the device assumes the position shown in the solid lines, i.e., the curtain portion hangs almost vertical. As the curtain liner, which for the purpose of the description can be termed the curtain, initially becomes wet, there is a tendency for its lower portion 22 to cling to the inner surface 23 of the outer wall 14 of the tub (FIG. 4). The user pushes the curtain out to the desired position, such as that shown in FIG. 4, and due to the biasing effect of the device, it assumes the position, also shown in FIG. 4, and due to wetness of the curtain, the curtain and device 25 remain in the shown positions. Due to the clinging effect between the curtain engaging portion of the device and the curtain, it is unnecessary to utilize a heavily weighted arrangement in the biasing means, and accordingly, the elongated section 34 normally hang substantially vertical when the curtain is open. When the curtain is held in the position shown in FIG. 4, the lower portion 22 of the curtain remains adhered to the inside of the tub wall, particularly in view of the angle at which the curtain extends above the rim 13, and thus the flow of cold air into the lower portion of the shower is prevented.

It can be seen from the above description, that although of simple design and therefore of economic structure, the device of the present invention is effective in improving the comfort of the user of a shower in that it maintains the wet curtain away from the user and prevents the inflow of cold air into the shower area. If the lower portion of the curtain is provided with magnets, as indicated above, the effects of the device and the magnets compliment each other.

Figure 7:
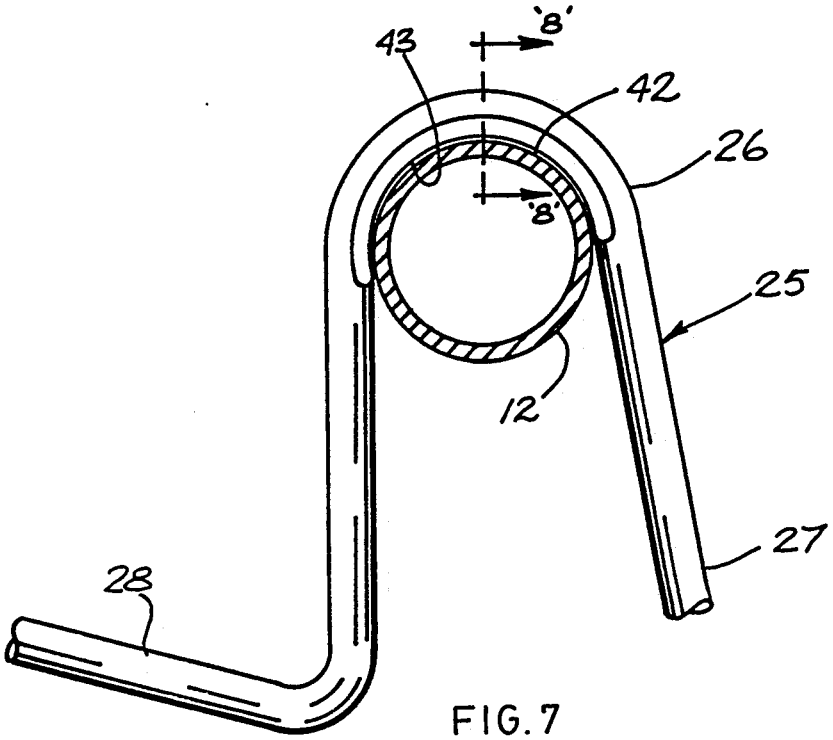
FIG. 7 is a side view similar to FIG. 1 but of a portion of the device and showing an alternative embodiment.
Figure 8:
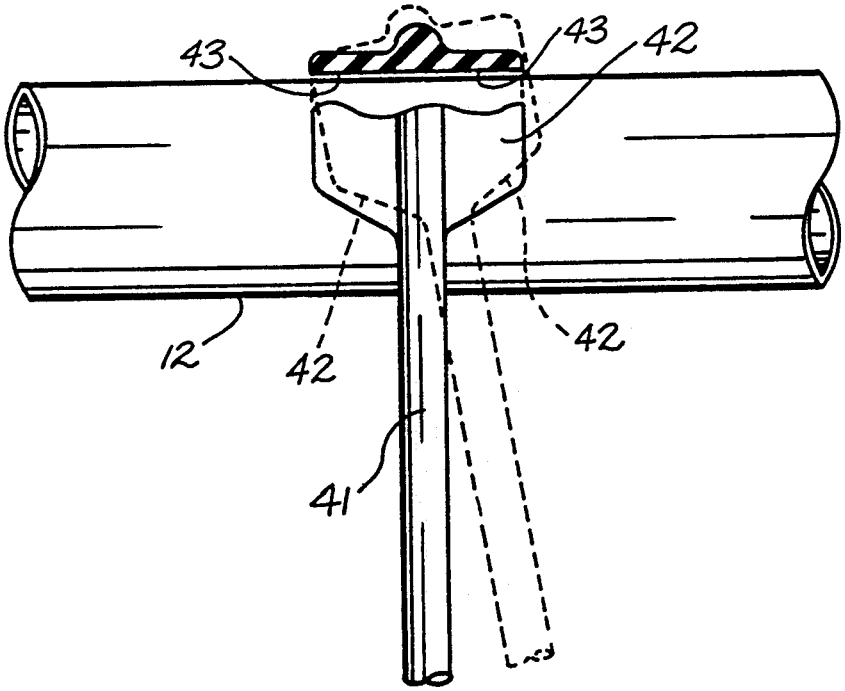
FIG. 8 is a cross sectional view through the device of the embodiment of FIG. 7 as seen from the line 8—8 of FIG. 7.

In the embodiment shown in FIGS. 7 and 8, a continuous rod 41, which makes up the control device 25', is of circular cross section, and in order to stabilize the device and to assist it to always return to a vertical position, as opposed to the position shown in dashed lines in FIG. 8, the curved midportion of the mounting means is provided with side flanges 42,42 which project laterally from opposite sides of the midportion. If the device is integrally formed of a moulded plastic material, the flanges may be integrally formed with the rod at the midportion, it being preferable that the inner surfaces 43,43 of the flanges are substantially on a tangential line of the inner curved surface of the rod which rests on the curtain rod 12, or form a surface in a common plane parallel to such a tangential line. If the rod is formed of a circular metal rod, the flanges may be welded to the side edges of the rod at the curved midportion. It can be seen that because of the presence of the flanges, the device has considerably more resistance to tipping sideways to the position shown in dashed lines of FIG. 8, such as when the curtain is being slid between its open and closed conditions, and if it does assume the tipped position, there is a tendency for it to fall back to its vertical or straight hanging position.

Referring now to FIG. 9, it may be noted that the section 36*a*, which extends from the inside leg 32 (not shown) includes a bent or hooked, upwardly open U-shaped portion 50 formed by a downwardly turned section 51, a bottom curved section 52 and a substantially upright portion 53. This provides a convenient means on which to hang containers of the type containing shampooing fluids, bath gels, etc. and which are provided with hooked portion molded into the container. Moreover, because the weight 37 which is provided with a bore 54 receives the upright portion 53 at the end of the rod so as to connect the weight to the section 36*a*, the weight is less likely to fall from the device in the event it becomes loose on the rod.

Although only two embodiment have been shown and described, numerous variations within the spirit of the invention as defined in the appending claims will be obvious to those skilled in the art.

What I claim is:

1. A shower curtain control device for controlling the position of a shower curtain having an inner and outer surface of the type suspended form a curtain rod of circular cross section having an inner surface toward the tub and an opposite outer surface positioned above an outside rim of a bathtub, said curtain being attached to curtain rod hooks slidable along said curtain rod to enable the curtain to be extended from an open position to a closed position in which said inner surface of the curtain defines one side of a shower area, said device comprising:

a mounting section having an opening for receiving said curtain rod and permitting both rotational pivoting and sliding movement of said device on said curtain rod, said mounting section including an inverted U-shape defining the rod receiving opening between a pair of downwardly extending legs jointed by a curved mid-portion for riding on top of said rod, one leg extending on the side of said inner surface of said curtain rod, the other leg extending on the side of said outer surface of said curtain rod, an elongated member connected to said other leg and depending therefrom and having a lower end portion for engagement with the inner surface of the curtain at a location spaced between the support rod and rim of said bathtub, and weight means including an elongated portion joined to said one leg of said pair and extending at an angle relative thereto projecting over said shower area for causing pivoting of said mounting section in a direction to swing said lower end portion of said elongated member outward from the shower area, whereby said curtain is held outward relative to the outer rim of said bathtub.

2. A shower curtain control device as defined in claim 1, wherein said elongated member is continuous with and extends downwardly from the outside leg of said pair, the lower end portion of said elongated member curving outwardly relative to the shower area and then inwardly.

3. A shower curtain control device as defined in claim 1, wherein said elongated portion forming said weight means extends from a lower end of the inside leg in a direction inward and slightly upward relative to said shower area.

4. A shower curtain control device as defined in claim 3, wherein said elongated portion terminates in a U-shaped portion defined by a downwardly turned section, a bottom curved section and a substantially upright section, and further including a weight means having an internal bore receiving said upright section.

5. A shower curtain control device as defined in claim 1, wherein said weight means further includes a weighted portion formed on the outer end of the elongated member joined to the inside leg.

6. A shower curtain control device as defined in claim 1, wherein the U-portion of the mounting means, the elongated member, and the elongated portion of the weighted means are formed as a continuous integral member.

7. A shower curtain control device as defined in claim 6, wherein said continuous integral member is in the form of a molded plastic rod.

8. A shower curtain control device as defined in claim 6, wherein said continuous member is in the form of a rod, and further comprising stabilizing side flanges projecting laterally from the curved mid-portion of the U-shaped portion of the mounting means.

9. A shower curtain control device as defined in claim 8, wherein said rod forming said device and said side flanges are moulded as an integral unit.

* * * * *